US006868831B2

(12) United States Patent
Lei

(10) Patent No.: US 6,868,831 B2
(45) Date of Patent: Mar. 22, 2005

(54) FUEL INJECTOR WITH CONTROLLED HIGH PRESSURE FUEL PASSAGE

(75) Inventor: Ning Lei, Oak Brook, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 649 days.

(21) Appl. No.: 10/002,937

(22) Filed: Nov. 15, 2001

(65) Prior Publication Data

US 2002/0053340 A1 May 9, 2002

Related U.S. Application Data

(63) Continuation-in-part of application No. 09/365,965, filed on Aug. 2, 1999, now Pat. No. 6,684,853.
(60) Provisional application No. 60/104,662, filed on Oct. 16, 1998.

(51) Int. Cl.[7] ..... F02M 37/04
(52) U.S. Cl. ..... 123/467; 123/458
(58) Field of Search ..... 123/446, 506, 123/514, 458, 447, 456; 251/30.01, 44

(56) References Cited

U.S. PATENT DOCUMENTS 4,624,233 A 11/1986 Phillips
4,706,932 A * 11/1987 Yoshida et al. ..... 251/31
5,526,791 A * 6/1996 Timmer et al. ..... 123/467
5,605,134 A * 2/1997 Martin ..... 123/467
5,651,345 A 7/1997 Miller et al.
5,862,792 A 1/1999 Paul et al.
5,906,351 A * 5/1999 Aardema et al. ..... 251/30.01
5,931,139 A 8/1999 Mack
5,984,200 A 11/1999 Augustin
6,029,632 A 2/2000 Augustin
6,119,960 A * 9/2000 Graves ..... 239/92

FOREIGN PATENT DOCUMENTS

WO WO 00/55496 A 9/2000

OTHER PUBLICATIONS

"DaimlerChrysler Pressure Controlled CR of HDD," AVL, S492/S3/99, IMechE Publ. 1999–1Z.

* cited by examiner

*Primary Examiner*—Carl S. Miller
(74) *Attorney, Agent, or Firm*—Dennis Kelly Sullivan; Susan L. Lukasik; Jeffrey P. Calfa

(57) ABSTRACT

A unit fuel injector, the injector internally preparing fuel during an injection event at a pressure sufficient for injection by means of an intensifier driven by a pressurized non-fuel actuating fluid selectively ported to the intensifier, includes a selectively actuatable controller interposed in a fuel passage, the fuel passage effecting fluid communication between an intensifier fuel chamber and a needle valve, the controller being shiftable between an open and a closed disposition for selectively opening and closing the fuel passage during the injection event A control apparatus and a method of injection timing control are further included.

36 Claims, 5 Drawing Sheets

BLOCKED HIGH PRESSURE FUEL PASSAGE

BLOCKED HIGH PRESSURE FUEL PASSAGE

UNBLOCKED HIGH PRESSURE FUEL PASSAGE

FUEL INJECTOR WITH CONTROLLED HIGH PRESSURE FUEL PASSAGE

RELATED APPLICATIONS

This application is a continuation-in-part of U.S. Non-Provisional Application Ser. No. 09/365,965, filed Aug. 2, 1999 now U.S. Pat. No. 6,684,853 which claims the benefit of U.S. Provisional Application Ser. No. 60/104,662, filed Oct. 16, 1998.

TECHNICAL FIELD

The present application relates to unit fuel injector, the injector internally preparing fuel during an injection event at a pressure sufficient for injection by means of an intensifier driven by a pressurized non-fuel actuating fluid selectively ported to the intensifier. More particularly, the present application relates to needle valve control in such injector.

BACKGROUND AND PRIOR ART

Referring to the prior art drawings more particularly by reference numbers, FIG. 2 shows a prior art fuel injector 50. The fuel injector 50 is typically mounted to an engine block and injects a controlled pressurized volume of fuel into a combustion chamber (not shown). The injector 50 is typically used to inject diesel fuel into a compression ignition engine, although it is to be understood that the injector could also be used in a spark ignition engine or any other system that requires the injection of a fluid.

The fuel injector 50 has an injector housing 52 that is typically constructed from a plurality of individual parts. The housing 52 includes an outer casing 54 that contains block members 56, 58, and 60. The outer casing 54 has a fuel port 64 that is coupled to a fuel pressure chamber 66 by a fuel passage 68. A first check valve 70 is located within fuel passage 68 to prevent a reverse flow of fuel from the pressure chamber 66 to the fuel port 64. The pressure chamber 26 is coupled to a nozzle chamber 304 and to a nozzle 72 through fuel passage 74. A second check valve 76 is located within the fuel passage 74 to prevent a reverse flow of fuel from the nozzle 72 and the nozzle chamber 304 to the pressure chamber 66.

The flow of fuel through the nozzle 72 is controlled by a needle valve 78 that is biased into a closed position by spring 80 located within a spring chamber 81. The needle valve 78 has a shoulder 82 in the nozzle chamber 304 above the location where the passage 74 enters the nozzle 78. When fuel flows in the passage 74, the pressure of the fuel applies a force on the shoulder 82 in this nozzle chamber 304. The shoulder force acts against the bias of spring 80 and lifts the needle valve 78 away from the nozzle openings 72, allowing fuel to be discharged from the injector 50.

A passage 83 may be provided between the spring chamber 81 and the fuel passage 68 to drain any fuel that leaks into the chamber 81. The drain passage 83 prevents the build up of a hydrostatic pressure within the chamber 81 which could create a counteractive force on the needle valve 78 and degrade the performance of the injector 10.

The volume of the pressure chamber 66 is varied by an intensifier piston 84. The intensifier piston 84 extends through a bore 86 of block 60 and into a first intensifier chamber 88 located within an upper valve block 90. The piston 84 includes a shaft member 92 which has a shoulder 94 that is attached to a head member 96. The shoulder 94 is retained in position by clamp 98 that fits within a corresponding groove 100 in the head member 96. The head member 96 has a cavity which defines a second intensifier chamber 102.

The first intensifier chamber 88 is in fluid communication with a first intensifier passage 104 that extends through block 90. Likewise, the second intensifier chamber 102 is in fluid communication with a second intensifier passage 106.

The block 90 also has a supply working passage 108 that is in fluid communication with a supply working port 110. The supply working port 110 is typically coupled to a system that supplies a working fluid which is used to control the movement of the intensifier piston 84. The working fluid is typically a hydraulic fluid, typically engine lubricating oil, that circulates in a closed system separate from fuel. Alternatively the fuel could also be used as the working fluid. Both the outer body 54 and block 90 have a number of outer grooves 112 which typically retain O-rings (not shown) that seal the injector 10 against the engine block. Additionally, block 62 and outer shelf 54 may be sealed to block 90 by O-ring 114.

Block 60 has a passage 116 that is in fluid communication with the fuel port 64. The passage 116 allows any fuel that leaks from the pressure chamber 66 between the block 62 and piston 84 to be drained back into the fuel port 64. The passage 116 prevents fuel from leaking into the first intensifier chamber 88.

The flow of working fluid into the intensifier chambers 88 and 102 can be controlled by a fourway solenoid control valve 118. The control valve 118 has a spool 120 that moves within a valve housing 122. The valve housing 122 has openings connected to the passages 104, 106 and 108 and a drain port 124. The spool 120 has an inner chamber 126 and a pair of spool ports that can be coupled to the drain ports 124. The spool 120 also has an outer groove 132. The ends of the spool 120 have openings 134 which provide fluid communication between the inner chamber 126 and the valve chamber 134 of the housing 122. The openings 134 maintain the hydrostatic balance of the spool 120.

The valve spool 120 is moved between the first position shown in prior art FIG. 2 and a second opposed position, by a first solenoid 138 and a second solenoid 140. The solenoids 138 and 140 are typically coupled to a controller which controls the operation of the injector. When the first solenoid 138 is energized, the spool 120 is pulled to the first position, wherein the first groove 132 allows the working fluid to flow from the supply working passage 108 into the first intensifier chamber 88, and the fluid flows from the second intensifier chamber 102 into the inner chamber 126 and out the drain port 124. When the second solenoid 140 is energized the spool 120 is pulled to the second position, wherein the first groove 132 provides fluid communication between the supply working passage 108 and the second intensifier chamber 102, and between the first intensifier chamber 88 and the drain part 124.

The groove 132 and passages 128 are preferably constructed so that the initial port is closed before the final port is opened. For example, when the spool 120 moves from the first position to the second position, the portion of the spool adjacent to the groove 132 initially blocks the first passage 104 before the passage 128 provides fluid communication between the first passage 104 and the drain port 124. Delaying the exposure of the ports reduces the pressure surges in the system and provides an injector which has predictable firing points on the fuel injection curve.

The spool 120 typically engages a pair of bearing surfaces 142 in the valve housing 122. Both the spool 120 and the housing 122 are preferably constructed from a magnetic material such as a hardened 52100 or 440c steel, so that the hystersis of the material will maintain the spool 120 in either the first or second position. The hystersis allows the solenoids 138, 140 to be de-energized after the spool 120 is pulled into position. In this respect the control valve 118 operates in a digital manner, wherein the spool 120 is moved by a defined power pulse that is provided to the appropriate solenoid 138,140. Operating the valve 118 in a digital manner reduces the heat generated by the coils and increases the reliability and life of the injector 50.

In operation, the first solenoid 138 is energized and pulls the spool 120 to the first position, so that the working fluid flows from the supply port 110 into the first intensifier chamber 88 and from the second intensifier chamber 102 into the drain port 124. The flow of working fluid into the intensifier chamber 88 moves the piston 84 and increases the volume of chamber 66. The increase in the chamber 66 volume decreases the chamber pressure and draws fuel into the chamber 66 from the fuel port 64. Power to the first solenoid 138 is terminated when the spool 120 reaches the first position.

When the chamber 66 is filled with fuel, the second solenoid 140 is energized to pull the spool 120 into the second position. Power to the second solenoid 140 is terminated when the spool 120 reaches the second position. The movement of the spool 120 allows working fluid to flow into the second intensifier chamber 102 from the supply port 110 and from the first intensifier chamber 88 into the drain port 124.

The head 96 of the intensifier piston 96 has an area much larger than the end of the piston 84, so that the pressure of the working fluid generates a force that pushes the intensifier piston 84 and reduces the volume of the pressure chamber 66. The stroking cycle of the intensifier piston 84 increases the pressure of the fuel within the pressure chamber 66 and, by means of passage 74, in the nozzle chamber 304. The pressurized fuel acts on shoulder 82 in the nozzle chamber 304 to open the needle valve 78 and fuel is then discharged from the injector 50 through the nozzle 72. The fuel is typically introduced to the injector at a pressure between 1000–2000 psi. In the preferred embodiment, the piston has a head to end ratio of approximately 10:1, wherein the pressure of the fuel discharged by the injector is between 10,000–20,000 psi.

The HEUI injector 50 described above is commonly referred to as the G2 injector. The G2 injector 50 uses a fast digital spool valve 120 to control multiple injection events. During its operation, every component inside of the injector 50 (spool valve 120, intensifier piston 84, and needle valve 78) has to open/close multiple times to either trigger the injection or stop the injection during the injection event. Note, a full injection event is depicted in prior art FIG. 3 (FIG. 3 of the '329 patent). The digital spool valve 120 (prior art FIG. 2) has to handle large flow capacity to supply actuation liquid to the intensifier piston 78. The spool valve 120 size is relatively big and the response of a large spool valve 120 is therefore limited.

The intensifier 84 is also relatively large in mass. Therefore reversing the motion of the intensifier 84 to achieve pilot injection operation is inefficient. Once committed to compression of fuel for injection, it is much more efficient to maintain the intensifier 84 motion in the compressing stroke throughout the duration of the injection event.

Reversing of the motion of the spool valve 120 and the intensifier piston 84 results in the injection event no longer being a single shot injection, but effectively multiple short independent injection events during the injection event. Referring to prior art FIG. 3, both the motion of the spool valve 120 and the intensifier piston 84 must be reversed in the duration between the pilot injection and the main injection and reversed again to effect the main injection. With such relatively massive devices as the spool valve 120 and the intensifier piston 84, this is highly inefficient.

It is believed that pilot or split injection should be injection interruptions effected during a single shot injection, e.g., with no motion reversal of either the spool valve 120 or the intensifier piston 84, but with control of the needle valve 78 opening and closing motions. As indicated above, the intensifier piston 84 has relatively large mass hence it is difficult or slow to reverse its motion.

A responsive injection system should locate its injection control as close to the needle valve 78 as possible and should also avoid reverse motion of the intensifier 84 and, preferably, of the spool valve 120. Therefore, there is a need in the industry to utilize a mechanism to efficiently control the high pressure fuel flow from the plunger chamber 66 to the nozzle chamber 304. By controlling the fuel supply to the nozzle chamber 304, efficient control of needle valve 78 opening and closing can be achieved.

SUMMARY OF THE INVENTION

The present invention substantially meets the needs of the industry. Control of the needle valve multiple times during an injection event is achieved by a device that permits the spool valve to cycle only a single time, open at the initiation of the injection event and close at the termination of the injection event, and the intensifier piston to maintain a continuous compressing stroke during the injection event.

The present invention is unit fuel injector, the injector internally preparing fuel during an injection event at a pressure sufficient for injection by means of an intensifier driven by a pressurized non-fuel actuating fluid selectively ported to the intensifier, including a selectively actuatable controller interposed in a fuel passage, the fuel passage effecting fluid communication between an intensifier fuel chamber and a needle valve, the controller being shiftable between an open and a closed disposition for selectively opening and closing the fuel passage during the injection event The present invention is further a control apparatus and a method of injection timing control.

DETAILED DESCRIPTION OF THE DRAWINGS

Figure 1:
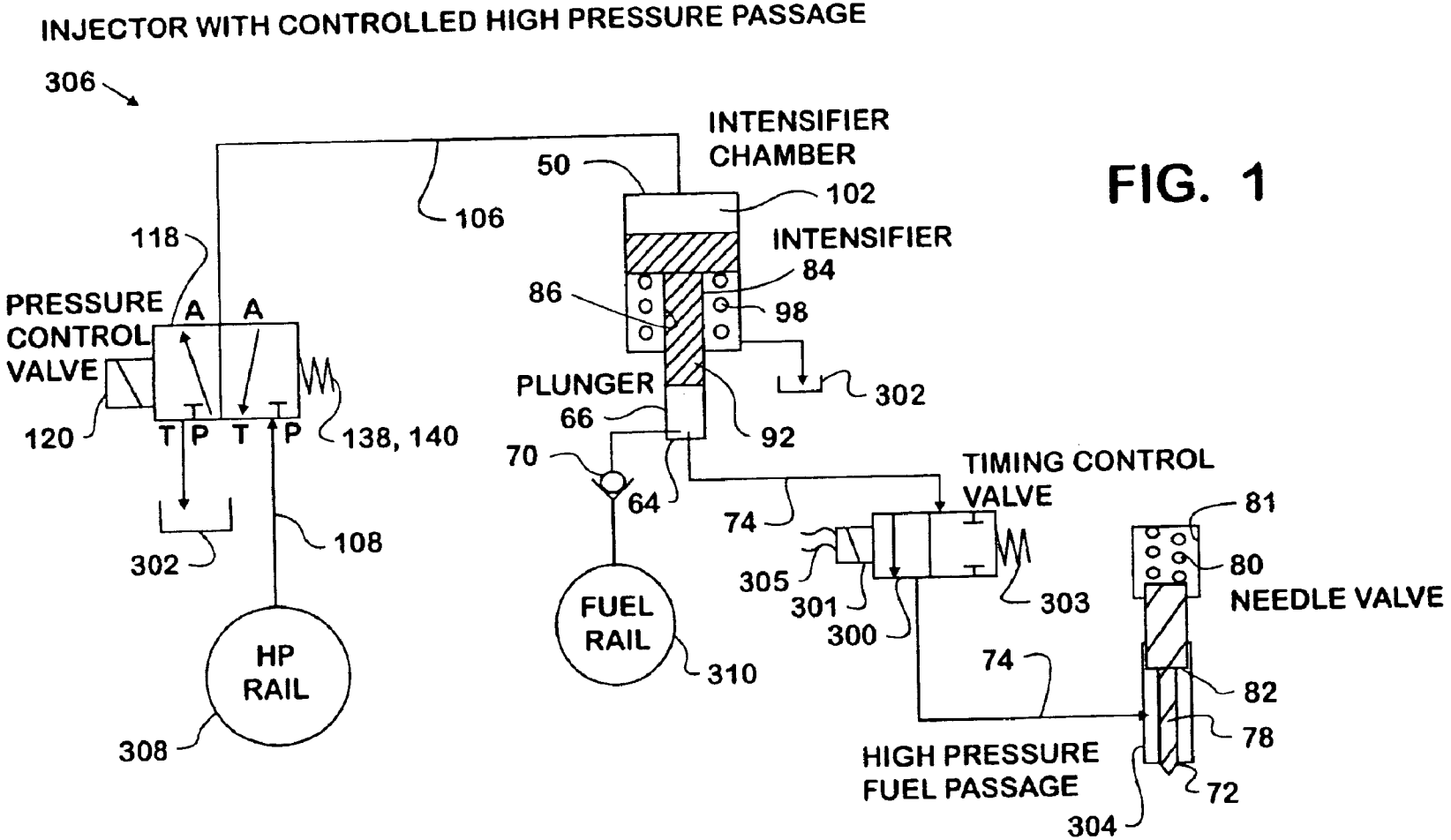
FIG. 1 is a schematic representation of the timing control valve of the present invention.
Figure 2:
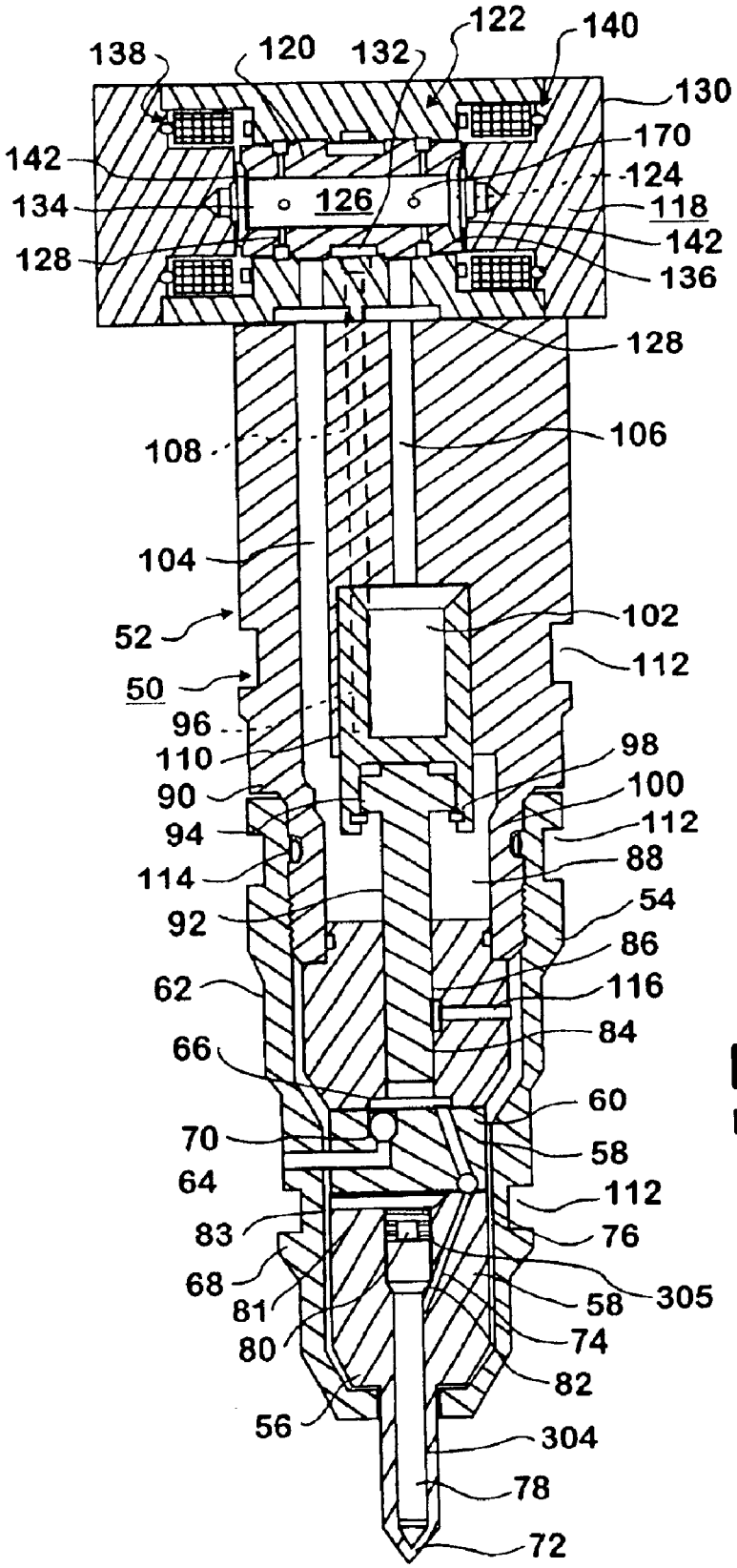
FIG. 2 PRIOR ART
FIG. 2 is sectional representation of a prior art unit injector.

Referring to FIG. 1 of the present application (numbers in FIG. 1 of the present application correspond to like numbers in prior art FIG. 2, which is FIG. 4 of the '329 patent), the schematic depicted illustrates the timing control valve 300 of the present invention integrated into a prior art HEUI injector 50. The injector 50 is depicted integrated into a fuel injection system 306. The fuel injection system 306 includes pressure control valve 118 (including spool valve 120), timing control valve 300, an intensifier piston 84 and its biased spring 98, a needle valve 78 and its biased spring 80, a common rail 308 to provide hydraulic actuation pressure, and a fuel rail 310 supplying relatively low pressure fuel to the injector 50. The injector 50 includes the aforementioned components with the exception of the low pressure reservoir 302, the common rail 308, and the fuel rail 310.

The pressure control valve 118 is a three-way valve. The pressure control valve 118 allows hydraulic actuation liquid to flow from the common rail 308 via passage 106 to the intensifier 84 when the pressure control valve 118 is open. The pressure control valve 118 drains intensifier chamber 102 pressure to ambient or to low pressure reservoir 302 when the pressure control valve 118 is at a closed position.

The timing control valve 300 of the present invention is interposed in the high pressure fuel passage 74 that connects the pressure chamber 66 and nozzle chamber 304. The timing control valve 300 is preferably an open/closed two-position valve. The timing control valve 300 is disposable in a first blocking disposition by actuation of a solenoid 301 (see FIG. 4) and is disposable in a second opposed open (or unblocked) disposition by a spring 303 bias (see FIG. 5). Leads 305 provide for selective electric actuation of the solenoid 301 in opposition to the bias of the spring 303. It is understood that other forms of controllable blockage of the high pressure fuel passage 74 are also encompassed by the present application. An opening solenoid and a closing solenoid could as well be used. A dedicated controller can modulate fuel flow and fuel pressure to the nozzle chamber 304 by means of timing control valve 300 for more refined control of the motion of the needle valve 78.

Figure 4:
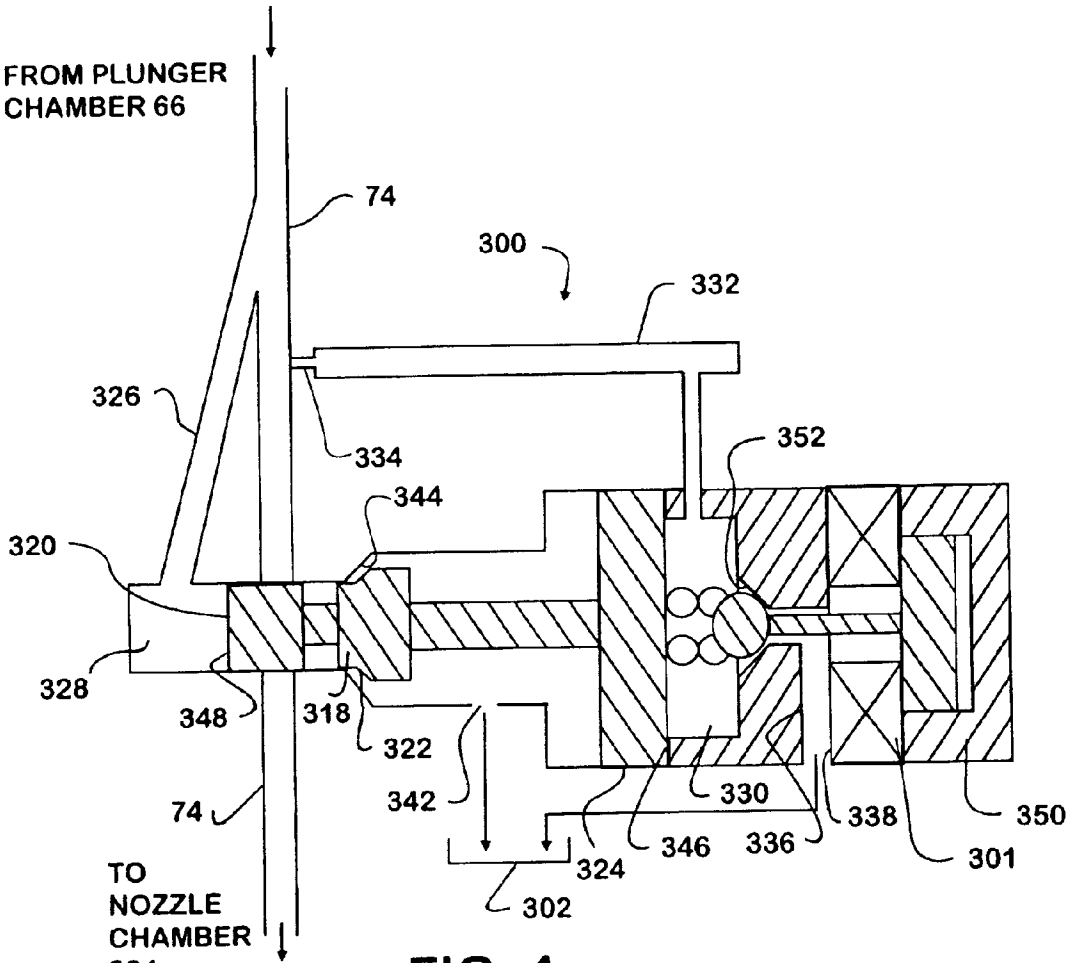
FIG. 4 is a schematic of an exemplary timing control valve in the blocked disposition.
Figure 5:
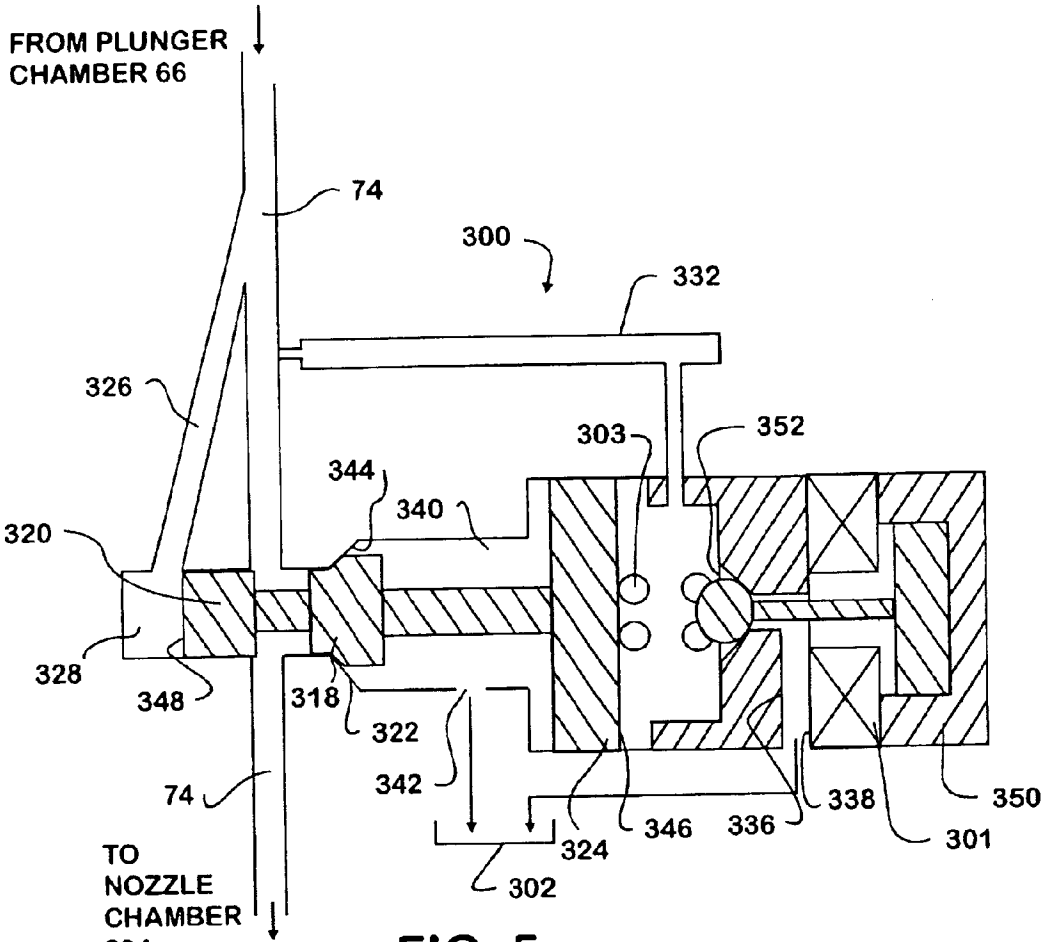
FIG. 5 is a schematic of an exemplary timing control valve in the unblocked disposition.

Referring to FIGS. 4 and 5, the timing control valve 300 is depicted as an electronically controlled and hydraulically actuated spool valve 318 that is used to control the flow of high pressure fuel from the plunger chamber 66 to the nozzle chamber 304 via the high pressure fuel passage 74. Spool valve 318 has three different lands, blocking land 320, seal land 322, and actuation land 324. A passageway 326 links the high pressure fuel passage 74 directly to the blocking chamber 328 on one side of the blocking land 320. Pressure in the blocking chamber 328 is at or very nearly the same as pressure in the high pressure fuel passage 74 due to unrestricted communication via passage 326.

An actuation chamber 330 is connected to the high pressure fuel passage 74 by the passage 332. Flow in the passage 332 is restricted by a throttle orifice 334. Pressure in the actuation chamber 330 is substantially the same as pressure in the high pressure fuel passage 74 when the ball valve 336 is closed as depicted in FIG. 5. The ball valve 336 typically seals the actuation chamber 330 when the ball valve 336 is in the closed disposition. When the ball valve 336 is open, as depicted in FIG. 4, pressure in the actuation chamber 330 is significantly reduced relative to pressure in high pressure fuel passage 74 due to the throttle effect at throttle orifice 334 and leakage past the ball valve 336 and out the vent 338 to the low pressure fuel reservoir 302. It should be noted that the volume 340 between the actuation land 324 and the seal land 322 is vented by means of vent 342 to the low pressure fuel reservoir 302.

The blocking land 320 is used to open and close the high pressure fuel passage 74 as the spool valve 318 moves from one position to the other. The blocking chamber 328 has the same pressure as the pressure in the high pressure fuel passage 74 by means of the passage 326.

The seal land 322 is used to seal off the leakage from the high pressure fuel passage 74 when the seal land 322 is seated on its conical seat 344, as depicted in FIG. 5.

The diameter of the actuation land 324 is greater than the diameter of the blocking land 320. Accordingly, the actuation surface 346 of the actuation land 324 is greater than the actuation surface 348 of the blocking land 320. The actuation surface 346 of the actuation land 324 is exposable to high pressure fuel from high pressure fuel passage 74. The other side of the actuation land 324 is exposed to the volume 340 which, as indicated above, is vented to the low pressure fuel reservoir 302. It should be noted that hydraulic force differential exerted on the actuation surfaces 346, 348 in the respective actuation chamber 330 and blocking chamber 328 causes the spool valve 318 to shift between the blocked and unblocked dispositions.

A solenoid controlled armature is used to directly control the position of the ball valve 336. When the solenoid 302 is energized, the armature 350 translates leftward as depicted in FIG. 4 and pushes the ball valve 336 to the open disposition. A relatively small amount of fuel can then leak past the ball valve seat 352 to the vent 338. In the blocked disposition, pressure in the actuation chamber 330 is much lower than pressure at the high pressure fuel passage 74 due to the significant throttling effect at the throttle orifice 334 and also due to the opening of the ball valve 336. In such disposition, hydraulic force acting on the actuation surface 348 of the blocking land 320 is significantly higher than the force acting on the actuation surface 346 of the actuation land 324. This imbalance in force causes the spool valve 318 to shift rightward to the blocking disposition blocking fuel flow in the high pressure fuel passage 74, as depicted in FIG. 4. This blocked disposition may be used, for example, either to prevent fuel flow to the nozzle chamber 304 or to interrupt fuel flow to the nozzle chamber 304 during an injection event as described in more detail herein.

When the solenoid 301 is deenergized, hydraulic pressure in the actuation chamber 330 and the bias of the spring 303 acts to shift the ball valve 336 into sealing engagement with the seat 352 and to translate the armature 350 rightward to the disposition as indicated in FIG. 5. When the ball valve 336 is seated, fuel leakage past the ball valve seat 352 is sealed off. Pressure in the actuation chamber 330 rises to the same level as the pressure in the high pressure fuel passage 74 (and in the blocking chamber 328) as soon as the ball valve 336 closes. Due to the area differential between the actuation surfaces 346, 348, hydraulic pressure force on the actuation land 324 is significantly higher than the force exerted on the blocking land 320. Accordingly, the spool valve 318 shifts from the blocked disposition of FIG. 4 to the unblocked disposition of FIG. 5. The spool valve 318 shifts leftward unblocking the high pressure fuel passage 74. The unblocked position of FIG. 5 is referred to as the normal open position where fuel is free to flow from the plunger chamber 66 to the nozzle chamber 304 for opening of the needle valve 78 without any restriction. In this position, the seal land 322 is seated on its conical seat 344, substantially sealing off the high pressure fuel passage 74.

Before injection starts, the entire injection system 306 of FIG. 1 is under low fuel pressure of about 50 psi, which is equal to the pressure in the low pressure fuel reservoir 302. The spool valve 318 of the timing control valve 300 is in its leftwardmost disposition as depicted in FIG. 5 with the seal land 322 seated on the seal land conical seat 344 under the bias of the spring 303. The ball valve 336 is seated on its seat 352. The nozzle chamber 304 and the intensifier plunger chamber 66 are in unrestricted fluid communication through the wide open high pressure fuel passage 74. In this disposition, an injection event is the same as described with reference to the base line prior art injector depicted in FIG.

2. Energizing the solenoid 301 of the spool valve 318 during an injection event causes the spool valve 318 to interrupt fuel flow from the plunger chamber 66 to the nozzle chamber 304 and results in split injection. Dwell between the split injection depends on the time duration the spool valve 318 blocks the high pressure fuel passage 74. During the period of blockage, a small amount of fuel leaks through the ball valve seat 352 since the ball valve 336 is in the open disposition. This leakage permits the intensifier plunger 84 to continue its compressive downward stroke at a slow rate of motion. In this manner, intensifier motion need not be stopped or reversed in order to achieve split injection. Optimum performance of the injector is achieved with appropriate sizing of the throttle orifice 334 to match the total stroke of the intensifier plunger 84.

At the normally open position of the timing control valve 300 (depicted in FIG. 5), high pressure fuel is free to flow from the plunger chamber 66 to the nozzle chamber 304 via high-pressure fuel passage 74 to cause injection. While the timing control valve 300 is at the closed (blocked) position (depicted in FIG. 4), high pressure fuel low from plunger chamber 66 to nozzle chamber 304 is being blocked off (needle valve 78 is therefore closed), thereby preventing injection of fuel from the orifices 72 to an engine combustion chamber.

The needle valve 78 operates as a conventional needle valve. Accordingly, if pressure in the nozzle chamber 304 acting on the surface 82 exceeds a known valve opening pressure (VOP) the needle valve 78 opens, exposing the orifices 72. The needle valve 78 opens against the bias exerted by the spring force of the spring 80 to the full open position when VOP is exceeded, thereby exposing the orifices 72. The needle valve 78 closes under the influence of the bias of spring 80 when the fuel pressure acting on surface 82 exerts a force that is lower than the force of the valve closing pressure resulting in the closing of the orifices 72.

In operation, rail pressure in the HP rail 308 is prepared externally by a supply pump (not shown) and an engine control valve (not shown). The HP rail 308 acts as an accumulator to provide relatively constant actuation pressure during a steady state operation of the engine. Pressure in the HP rail 308 is variable for various engine operating conditions and is pre-determined by an engine controller (not shown) based on sensed engine performance needs.

Before injection starts at orifices 72, the pressure control valve 118 is at the closed position, intensifier chamber 60 pressure is vented to near ambient tank pressure level, and the timing control valve 300 is also at the off position. The nozzle chamber 304 is wide open to the plunger chamber 66 and the nozzle chamber 304 and plunger chamber 66 are both filled with low pressure fuel as a result of being in communication with low pressure fuel reservoir 310. The needle valve 78 is closed due to the bias of spring 305 and absence of fuel pressure at nozzle chamber 304.

Depending on the interaction and control scheme of the two independent control valves 118, 302, different injection characteristics are obtainable as indicated below.

(1) Slow Initial Rate of the Injection

This operation is similar to a HEUI injector as described in the '329 patent without the timing control valve 300. Slow initial rate of injection is achieved with the timing control valve 300 maintained in the open position. At the beginning of the injection event, the pressure control valve 118 is turned on to port actuating fluid to the intensifier 84. The timing control valve 300 is maintained at the open position and the nozzle valve 78 is in fluid communication with plunger chamber 66 via passage 74. The intensifier 84 strokes downward against the bias of spring 98 and thereby compressing the volume of fuel in the plunger chamber 66. Plunger chamber 66 pressure builds up relatively gradually and the increasingly high-pressure affects the fuel in the nozzle chamber 304. The needle valve 78 opens against the bias of spring 305 to start injection. Pressure in the plunger chamber 66 and nozzle chamber 304 builds up relatively gradually as the intensifier 84 accelerates downward. When the pressure exceeds VOP, the needle valve 78 opens. Hence, the injection rate of fuel from the orifices 72 increases gradually. A slow initial rate of injection is desirable as it favors engine $NO_x$ emission control.

(2) Square rate of the injection

Figure 3:
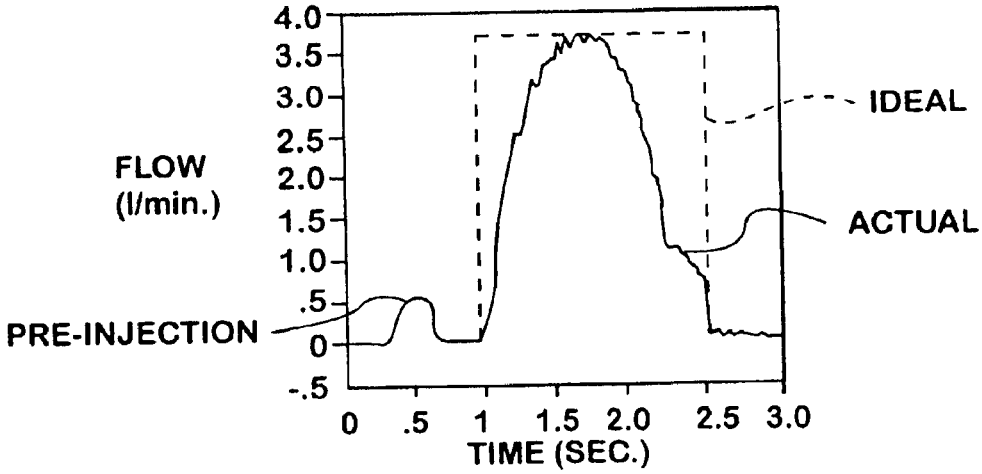
FIG. 3 PRIOR ART
FIG. 3 is a graphic representation of a prior art injection event.

A square rate of injection with a fast rise and decay in the rate of injection is depicted as ideal in FIG. 3 of the '329 patent, but would be expanded to extend over the entire injection event (no pre-injection). The injection event is initiated as indicated above. The timing control valve 300 is turned on and shifts to the blocking disposition shortly after initiation of the injection event and before injection pressure in plunger chamber 66 builds up due to the downward compressing stroke of the intensifier 84. The high pressure fuel passage 74 is blocked by the timing control valve 300 before the start of injection from the orifices 72. The pressure control valve 118 is then opened (unblocked), porting actuation fluid to the intensifier chamber 102 to drive the intensifier 84 downward. However, high pressure fuel cannot flow to the nozzle chamber 304 due to blockage of the high pressure fuel passage 74 by the closed timing control valve 300.

When the timing control valve 300 is closed resulting in the blockage of passage 74, pressure in the plunger chamber 102 and intensifier chamber 66 are fully developed and ready for injection without significant stroking of the intensifier 84 (the intensifier 84 is essentially in a state of hydraulic lock due to the blockage of the timing control valve 300). The timing control valve 300 is then opened up, the intensifier 84 strokes downward and supplies fuel flow to the needle valve 78 and nozzle orifices 72 continuously. Since the fuel pressure is fully developed, opening of the needle valve 78 occurs very rapidly to achieve the virtually instantaneous rise in rate of injection. End of the injection is achieved by simultaneously closing off both valves 118, 300 to achieve a nearly instantaneous cessation of fuel flow from the injector 50. With the nearly instantaneous decay in fuel pressure caused closing the timing control valve 300, the spring 80 acts to nearly instantaneously close the needle valve 78 to achieve the square end of the injection event.

(3) Multiple Injection Rate

Multiple injection occurrences during a single injection event is depicted, for example, as the pre-injection and actual injection occurrences in prior art FIG. 3 of the '329 patent Under multiple injection condition, the pressure control valve 118 is cycled from closed to open and back to closed only once during the injection event, while the timing control valve 300 may be cycled used many times during the injection event to effect the desired rate shaping or multiple injection rate of the injection throughout the duration of the injection event controlled by the pressure control valve 118. The pressure control valve 118 is maintained open to provide a constant supply of actuation pressure to the intensifier 84 and a constant supply of pressurized fuel in the plunger chamber 66. The timing control valve 300 is cycled as desired to interrupt the flow of pressurized fuel to the nozzle valve 78 for injection from the orifices 72. Due to the interruption of high-pressure fuel passage 74 effected by the timing control valve 300, the needle valve 78 either opens (when the timing control valve 300 is open) for injection or closes (when the timing control valve 300 is closed) to end injection responsive to the bias of spring 80.

What is claimed is:

1. A timing control mechanism for use with a fuel injector having an intensifier plunger and an intensifier chamber fluidly coupled to a needle valve chamber by a high pressure fuel passage, comprising;

a timing control valve in fluid communication with the high pressure fuel passage and being shiftable between a blocked disposition in which fuel flow in the high pressure fuel passage is substantially blocked and an unblocked disposition in which fuel flow in the high pressure fuel passage is substantially unrestricted, the timing control valve providing an alternative fuel flow path in fluid communication with the intensifier chamber when the timing control valve is in the blocked disposition.

2. The timing control mechanism of claim 1, the alternative fuel flow path accommodating compressive stroking motion of the intensifier plunger when the timing control valve is in the blocked disposition.

3. The timing control mechanism of claim 1, the alternative fuel flow path being throttled.

4. The timing control mechanism of claim 1, the alternative fuel flow path being in flow communication with a fuel volume at relatively low pressure.

5. The timing control mechanism of claim 1, the timing control valve having a blocking land, the blocking land having an actuation surface, the actuation surface being exposable to the pressure of the fuel in the high pressure fuel passage.

6. The timing control mechanism of claim 5, the blocking land actuation surface being substantially continuously exposed to the pressure of the fuel in the high pressure fuel passage.

7. The timing control mechanism of claim 5, the blocking land substantially blocking fuel flow in the high pressure fuel passage when the timing control valve is in the blocked disposition.

8. The timing control mechanism of claim 1, the timing control valve having an actuation land, the actuation land having an actuation surface, the actuation surface being exposable to the pressure of the fuel in the high pressure fuel passage.

9. The timing control mechanism of claim 8, the actuation land actuation surface having a greater area than a blocking land actuation surface.

10. The timing control mechanism of claim 8, fuel flow to the actuation land actuation surface being throttled through a throttling orifice.

11. A timing control mechanism for use with a fuel injector having an intensifier plunger and an intensifier chamber fluidly coupled to a needle valve chamber by a high pressure fuel passage, comprising:

a timing control valve in fluid communication with the high pressure fuel passage and being shiftable between a blocked disposition in which fuel flow in the high pressure fuel passage is substantially blocked and an unblocked disposition in which fuel flow in the high pressure fuel passage is substantially unrestricted, the timing control valve having a spring, the spring acting on both a first shiftable component and a second opposed shiftable component.

12. The timing control mechanism of claim 11, the spring acting simultaneously to bias a first valve in the unblocked disposition and to bias a second valve in a closed disposition.

13. The timing control mechanism of claim 12, the spring being disposed in a variable volume actuation chamber.

14. The timing control mechanism of claim 13, opening the second valve acting to fluidly vent the variable volume actuation chamber.

15. The timing control mechanism of claim 14, a solenoid and solenoid armature acting on the second valve in opposition to the bias of the spring.

16. The timing control mechanism of claim 14, selective venting of the actuation chamber affecting opposed hydraulic forces acting on the first valve, causing the first valve to selectively shift between the blocked and unblocked dispositions.

17. The timing control mechanism of claim 1 being hydraulically actuated and electronically controlled.

18. The timing control mechanism of claim 17, the hydraulic actuation being effected by fuel pressure.

19. A fuel injector comprising:

an intensifier plunger and an intensifier chamber fluidly coupled to a needle valve chamber by a high pressure fuel passage, and a timing control valve in fluid communication with the high pressure fuel passage and being shiftable between a blocked disposition in which fuel flow in the high pressure fuel passage is substantially blocked and an unblocked disposition in which fuel flow in the high pressure fuel passage is substantially unrestricted, the timing control valve providing an alternative fuel flow path in fluid communication with the intensifier chamber when the timing control valve is in the blocked disposition.

20. The fuel injector of claim 19, the alternative fuel flow path accommodating compressive stroking motion of the intensifier plunger when the timing control valve is in the blocked disposition.

21. The fuel injector of claim 19, the alternative fuel flow path being throttled.

22. The fuel injector of claim 19, the alternative fuel flow path being in flow communication with a fuel volume at relatively low pressure.

23. The fuel injector of claim 19, the timing control valve having a blocking land, the blocking land having an actuation surface, the actuation surface being exposable to the pressure of the fuel in the high pressure fuel passage.

24. The fuel injector of claim 23, the blocking land actuation surface being substantially continuously exposed to the pressure of the fuel in the high pressure fuel passage.

25. The fuel injector of claim 23, the blocking land substantially blocking fuel flow in the high pressure fuel passage when the timing control valve is in the blocked disposition.

26. The fuel injector of claim 19, the timing control valve having an actuation land, the actuation land having an actuation surface, the actuation surface being exposable to the pressure of the fuel in the high pressure fuel passage.

27. The fuel injector of claim 26, the actuation land actuation surface having a greater area than a blocking land actuation surface.

28. The fuel injector of claim 26, fuel flow to the actuation land actuation surface being throttled through a throttling orifice.

29. A fuel indicator comprising:

an intensifier plunger and an intensifier chamber fluidly coupled to a needle valve chamber by a high pressure fuel passage, and a timing control valve in fluid communication with the high pressure fuel passage and being shiftable between a blocked disposition in which fuel flow in the high pressure fuel passage is substantially blocked and an unblocked disposition in which fuel flow in the high pressure fuel passage is substantially unrestricted, the timing control valve having a spring, the spring acting on both a first shiftable component and a second opposed shiftable component.

30. The fuel injector of claim 29, the spring acting simultaneously to bias a first valve in the unblocked disposition and to bias a second valve in a closed disposition.

31. The fuel injector of claim 30, the spring being disposed in a variable volume actuation chamber.

32. The fuel injector of claim 31, opening the second valve acting to fluidly vent the variable volume actuation chamber.

33. The fuel injector of claim 32, a solenoid and solenoid armature acting on the second valve in opposition to the bias of the spring.

34. The fuel injector of claim 32, selective venting of the actuation chamber affecting opposed hydraulic forces acting on the first valve, causing the first valve to selectively shift between the blocked and unblocked dispositions.

35. The fuel injector of claim 29, being hydraulically actuated and electronically controlled.

36. The fuel injector of claim 35, the hydraulic actuation being effected by fuel pressure.

* * * * *